US007316213B2

(12) United States Patent
Teraya

(10) Patent No.: US 7,316,213 B2
(45) Date of Patent: Jan. 8, 2008

(54) VALVE TIMING CONTROL DEVICE AND CONTROL METHOD FOR INTERNAL COMBUSTION ENGINE

(75) Inventor: Ryuta Teraya, Toyota (JP)

(73) Assignee: Toyota Jidosha Kabushiki Japan, Toyota (JP)

( * ) Notice: Subject to any disclaimer, the term of this patent is extended or adjusted under 35 U.S.C. 154(b) by 0 days.

(21) Appl. No.: 11/528,346

(22) Filed: Sep. 28, 2006

(65) Prior Publication Data

US 2007/0101961 A1 May 10, 2007

(30) Foreign Application Priority Data

Nov. 7, 2005 (JP) ..... 2005-322743

(51) Int. Cl.
*F01L 1/34* (2006.01)

(52) U.S. Cl. ..... 123/90.17; 123/90.15; 123/347

(58) Field of Classification Search ..... 123/90.15, 123/90.16, 90.17, 90.18, 345, 346, 347, 348; 464/1, 2, 160
See application file for complete search history.

(56) References Cited

U.S. PATENT DOCUMENTS

| | | | |
|---|---|---|---|
| 5,181,484 A | 1/1993 | Kan et al. | |
| 6,619,248 B1 * | 9/2003 | Bertelshofer et al. | 123/90.15 |
| 2002/0010540 A1 | 1/2002 | Moriya et al. | |

FOREIGN PATENT DOCUMENTS

| | | |
|---|---|---|
| EP | 1 143 113 A2 | 10/2001 |
| JP | A 63-268960 | 11/1988 |
| JP | A 11-159311 | 6/1999 |
| JP | A 2004-270488 | 9/2004 |
| JP | 2004-308570 | 11/2004 |

OTHER PUBLICATIONS

Japan Institute of Invention and Innovation Technical Report, No. 2004-504520, Jul. 1, 2004.

* cited by examiner

*Primary Examiner*—Ching Chang
(74) *Attorney, Agent, or Firm*—Oliff & Berridge, PLC

(57) ABSTRACT

A valve timing control device is provided, allowing downsizing of an electric motor that drives a variable mechanism of valve timing. An electronic control device drives a VVT drive electric motor with a crankshaft rotated towards reducing the cam torque qualified as a resistance through a motor generator when a valve timing modification request is made in preparation to engine startup.

21 Claims, 5 Drawing Sheets

VALVE TIMING CONTROL DEVICE AND CONTROL METHOD FOR INTERNAL COMBUSTION ENGINE

This nonprovisional application is based on Japanese Patent Application No. 2005-322743 filed with the Japan Patent Office on Nov. 7, 2005, the entire contents of which are hereby incorporated by reference.

BACKGROUND OF THE INVENTION

1. Field of the Invention

The present invention relates to a valve timing control device that controls the valve timing through adjustment of the relative rotation phase of a crankshaft and a camshaft that is linked thereto in a driving manner.

2. Description of the Background Art

The approach disclosed in Patent Document 1 (Japanese Patent Laying-Open No. 2004-270488), for example, corresponds to such a conventional valve timing control device.

This device includes an electric motor qualified as the driving source of a variable mechanism that renders variable the relative rotation phase of a crankshaft and camshaft. When the valve timing is to be advanced, the rotation phase of the camshaft is modified towards the positive direction (forward direction) with respect to the crankshaft by driving the electric motor such that the rotational speed of the camshaft is increased. In contrast, when the valve timing is to be retarded, the rotation phase of the camshaft is modified towards the opposite direction with respect to the crankshaft by driving the electric motor such that the rotational speed of the camshaft is reduced.

There is also known a valve timing control device that controls the valve timing to attain an appropriate timing for startup when the internal combustion engine is to be started (for example, refer to Patent Document 2 (Japanese Patent Laying-Open No. 11-159311).

When valve timing control is to be executed in preparation to the startup of the engine, the valve timing at a device that allows valve timing control through an electric motor as disclosed in Patent Document 1 set forth above can be advanced or retarded by increasing or reducing the rotational speed of the electric motor according to a valve timing modification request.

The cam torque that increases and decreases periodically together with the rotation of the camshaft acts on the driving source of the camshaft. This cam torque is generated due to the elasticity of a valve spring acting on the cam. While the cam torque acts as a rotation resistance, the camshaft must be driven against this cam torque functioning as a resistance (resistance cam torque).

In the event of effecting valve timing control in preparation to engine startup in the mode of the electric motor employed as the driving source of a variable mechanism as set forth above, the variable mechanism will be motor-driven with the operation of the internal combustion engine stopped. This means that, when the valve timing is to be modified towards the side where the cam torque acts as a resistance with respect to the driving source, the electric motor must output torque of a level that can drive the variable mechanism against the resistance cam torque.

For example, assume that a valve timing modification request is made to rotate the camshaft until the resistance cam torque reaches the peak. In this case, valve timing modification corresponding to the aforementioned request can be effected by employing an electric motor that can output torque of a level that can drive the variable mechanism against the resistance cam torque attaining peak level. By employing such an electric motor, the valve timing can be modified whatever level the resistance cam torque may take within the variable range.

However, the requirement of a high output from the electric motor will impede downsizing of the electric motor, which in turn will impede downsizing of the internal combustion engine. The pursuit of such a high output that allows the variable mechanism to be driven against the resistance cam torque attaining the peak level raises concerns about the aforementioned problem becoming more noticeable.

SUMMARY OF THE INVENTION

In view of the foregoing, an object of the present invention is to provide a valve timing control device that allows downsizing of an electric motor that drives a variable mechanism of valve timing.

A configuration to achieve the above object and the advantage thereof will be described hereinafter.

According to an aspect of the present invention, a valve timing control device for an internal combustion engine includes a variable mechanism rendering the valve timing variable through modification of the relative rotation phase of a crankshaft and a camshaft linked to the crankshaft in a driving manner, a VVT (Variable Valve Timing) drive electric motor driving the variable mechanism, a retaining mechanism that can retain the valve timing at a desired timing, and a control unit controlling the valve timing to attain the desired timing through the variable mechanism in preparation to engine startup. When a valve timing modification request is made in preparation to engine startup, the control unit executes engine startup valve timing control to drive the VVT drive electric motor with the crankshaft rotated towards reducing the cam torque qualified as a resistance through a crankshaft drive electric motor differing from the VVT drive electric motor.

By virtue of the configuration set forth above, the crankshaft drive electric motor rotates the crankshaft towards reducing the cam torque qualified as a resistance (hereinafter, referred to as resistance cam torque) even if a valve timing modification request is made to drive the VVT drive electric motor towards increasing the cam torque, i.e. increasing the driving resistance of the camshaft. Therefore, the output torque of the VVT drive electric motor can be reduced correspondingly. Accordingly, downsizing of the VVT drive electric motor is allowed.

It is assumed that the control mode "to drive the VVT drive electric motor with the crankshaft rotated towards reducing the cam torque qualified as a resistance through a crankshaft drive electric motor differing from the VVT drive electric motor" includes the mode of initiating driving of the VVT drive electric motor after the crankshaft is rotated and stopped by the crankshaft drive electric motor as well as the mode of overlap between the driving periods of the VVT drive electric motor and crankshaft drive electric motor (with regards to the driving start period, either of the motors may be the first one to be driven, or both may start at the same time).

According to another aspect of the present invention, a valve timing control device for an internal combustion engine includes a variable mechanism rendering the valve timing variable through modification of the relative rotation phase of a crankshaft and a camshaft linked to the crankshaft in a driving manner, a VVT drive electric motor driving the variable mechanism, a retaining mechanism that can retain the valve timing at a desired timing, and a control unit controlling the valve timing to attain the desired timing through the variable mechanism in preparation to engine startup. When a valve timing modification request is made in preparation to engine startup, the control unit executes engine startup valve timing control to drive the VVT drive electric motor with the crankshaft rotated such that the cam torque qualified as a resistance reaches the peak through a crankshaft drive electric motor differing from the VVT drive electric motor.

By virtue of the configuration set forth above, the resistance cam torque can be raised to the peak through the rotary drive of the crankshaft by the crankshaft drive electric motor even if a valve timing modification request is made to drive the VVT drive electric motor such that the resistance cam torque becomes maximum (peak), i.e. the drive resistance of the camshaft reaches or exceeds the peak.

Therefore, the output torque of the VVT drive electric motor can be reduced as compared to the case where the camshaft is rotated by the VVT drive electric motor alone until the resistance cam torque is raised to the peak. Thus, downsizing of the motor is allowed.

It is assumed that the control mode "to drive the VVT drive electric motor with the crankshaft rotated such that the cam torque qualified as a resistance reaches the peak through a crankshaft drive electric motor differing from the VVT drive electric motor" includes the mode of initiating driving of the VVT drive electric motor after the crankshaft is rotated and stopped by the crankshaft drive electric motor as well as the mode of overlap between the driving periods of the VVT drive electric motor and crankshaft drive electric motor (with regards to the driving start period, either of the motors may be the first one to be driven, or both may start at the same time).

Preferably, a reduction gear by use of a cycloid mechanism is employed as the retaining mechanism. An input shaft revolving one of a ring gear and a pinion gear meshing with the ring gear, constituting the reduction gear, is linked to the rotational shaft of the VVT drive electric motor in a driving manner. The other of the ring gear and pinion gear is secured to a rotary element that moves in conjunction with the crankshaft. An output shaft transmitting the rotation of one or the other of the gears on its axis caused by the revolution of one of the gears is linked to the camshaft in a driving manner.

The reduction gear by use of a cycloid mechanism serves to cause the output shaft to generate rotational speed lower than that of the input shaft by transferring the rotary motion of one or the other of the ring gear and pinion gear constituting the reduction gear by use of a cycloid mechanism on its axis that occurs by the revolution of one or the other of the ring gear and pinion gear in an orbit based on the rotation of the input shaft.

The reduction gear functions to retain constant the relative rotation phase between the output shaft and input shaft without increasing the speed of the input shaft even if rotary drive force is applied to the output shaft. Further, the reduction gear also functions to retain constant the relative rotation phase between the one of the gears that does not revolve in an orbit by the rotation of the input shaft, i.e. the other gear, and the output shaft even if rotary drive force is applied to the output shaft.

Therefore, even if cam torque is transmitted from the camshaft to the output shaft, the relative rotation phase of the camshaft and the rotational shaft of the VVT drive electric motor and also the relative rotation phase of the camshaft and the crankshaft are retained constant. This relative rotation phase retaining capability is valid no matter what value the relative rotation phase takes. This function allows the valve timing to be retained at the desired timing.

Additionally, the reduction gear functions to retain constant the relative rotation phase between one of the gears that does not revolve in an orbit by the rotation of the input shaft, i.e. the other gear (rotary element) and the input shaft as well as the relative rotation phase between that other gear and the output shaft even if rotary drive force is applied to that other gear.

Accordingly, by the rotation of the crankshaft, the camshaft can be rotated in synchronization via the rotary element that moves in conjunction with the crankshaft. Further, when the VVT drive electric motor is not being driven, the rotational shaft thereof can be rotated integrally (dragged) with the rotary element, and in turn with the camshaft, based on the rotation of the crankshaft. Accordingly, the energy can be saved and the durability of the battery (secondary battery) qualified as the power source can be improved since power does not have to be fed to the VVT drive electric motor when it is not required to modify the valve timing.

The present invention is also advantageous in that the output torque of the VVT drive electric motor can be reduced correspondingly by the reduction capability of the reduction gear by use of a cycloid mechanism. This allows the motor to be reduced in size.

By employing a reduction gear by use of a cycloid mechanism functioning as the retaining mechanism, the valve timing can be modified, when requested, while the camshaft moves in conjunction with the crankshaft, in addition to the valve timing retain function. This in turn provides various advantages such as allowing downsizing of the VVT drive electric motor.

Further preferably, the control unit drives the crankshaft drive electric motor to rotate the camshaft until the cam torque functions to assist modification of the valve timing in the engine startup valve timing control.

The cam torque has the variation properties of exhibiting alternately in a periodic manner a resistance to rotation (resistance cam torque) and assisting the rotation in association with the rotation of the camshaft. Since the crankshaft drive electric motor is driven until the cam torque functions to assist the rotation of the camshaft in the present invention, the output torque of the VVT drive electric motor in a valve timing modification mode can be reduced significantly.

The control mode by the control unit may include the case where the crankshaft drive electric motor is driven until the resistance cam torque is reduced to the level of a torque value that allows the camshaft to be rotated by the VVT drive electric motor alone, and driving the VVT drive electric motor after the crankshaft drive electric motor is stopped to conduct valve timing modification.

In this case, the driving amount of the motor must be controlled accurately since the crankshaft drive electric motor is to be stopped with the resistance cam torque reduced to a certain predetermined torque value as set forth above.

To this end, the control unit employs the control mode of driving the VVT drive electric motor while driving the crankshaft drive electric motor in engine startup valve timing control in the present invention. Accordingly, the driving amount of the crankshaft drive electric motor is arbitrary as long as it is sufficient for modification of the valve timing. For example, the driving amount can be set constant (for example, a driving amount corresponding to several cycles of the variation cycle of the resistance cam torque). Therefore, the control mode by the control unit can be rendered simple.

Since the relative rotation phase of the crankshaft and the camshaft is modified, i.e. the valve timing is modified, by the VVT drive electric motor while the camshaft is driven in rotation by the crankshaft drive electric motor, the time from a valve timing modification request up to completion of modification can be shortened.

Further preferably, the control unit drives the crankshaft drive electric motor to rotate the crankshaft in the opposite direction in the engine startup valve timing control.

In accordance with such a configuration, the unburned gas remaining in the combustion chamber can be returned to the intake manifold since the crankshaft is rotated in the opposite direction (the direction differing from the direction of rotation when the engine is driven). This prevents the unburned gas from being exhausted outside via the exhaust manifold.

Further preferably, the control unit executes the engine startup valve timing control in response to an engine stop request.

Since the valve timing control is completed already in preparation to engine startup when an engine startup request is made, the time from an engine startup request up to completion of engine startup can be shortened as compared to the case where the engine startup valve timing control is executed in response to an engine startup request.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention will be described according to FIGS. 1-6 based on an embodiment of a valve timing control device for a 4-cycle multicylinder (in the present invention, in-line 4-cylinder or V8-cylinder) internal combustion engine incorporated in a hybrid vehicle. The hybrid vehicle includes both an internal combustion engine and a motor generator as a running drive source.

Figure 1:
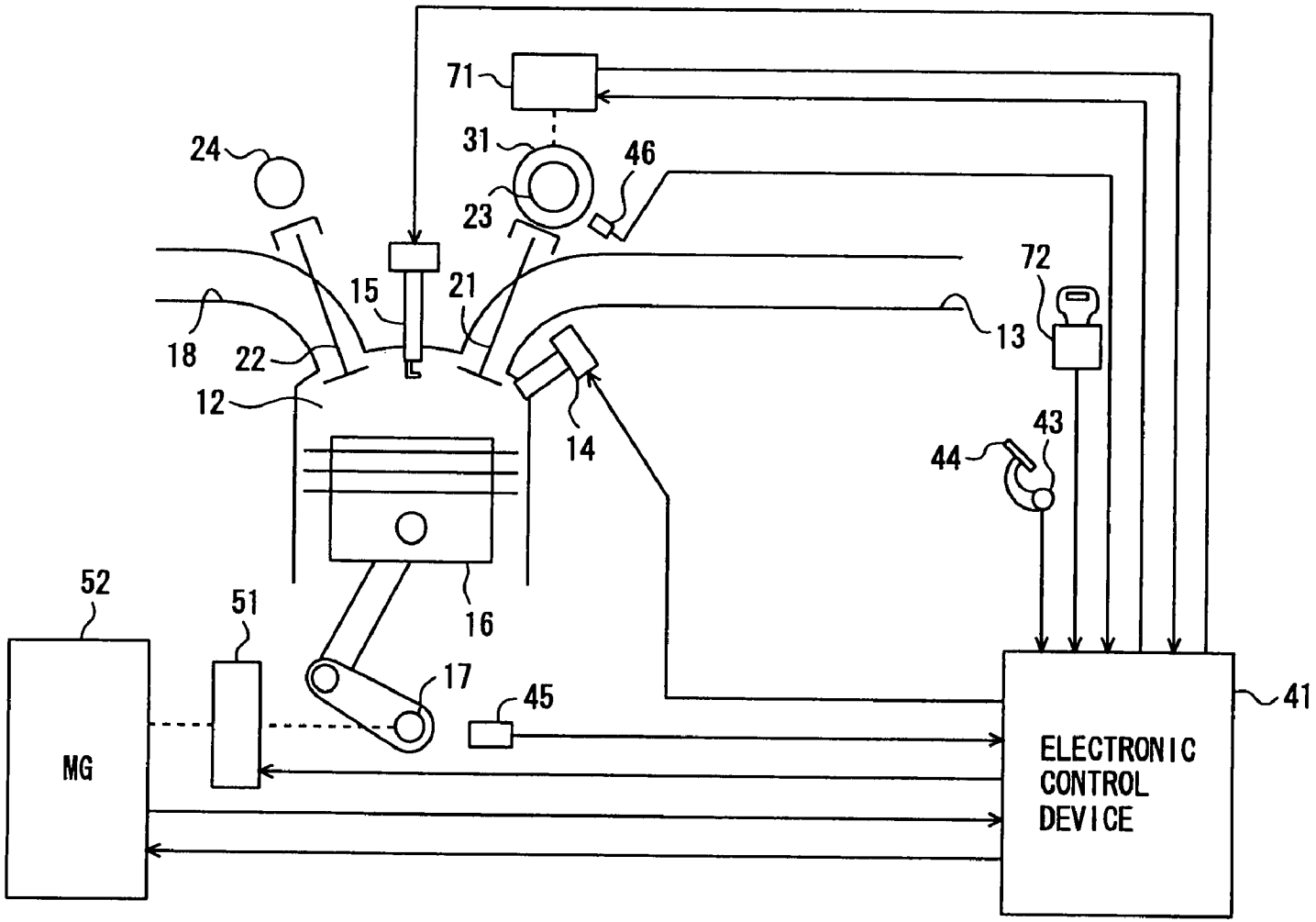
FIG. 1 schematically shows a valve timing control device for an internal combustion engine according to an embodiment.

Referring to FIG. 1, each combustion chamber 12 (only one is illustrated in the drawing) of an internal combustion engine 11 draws in air through an intake manifold 13 and has fuel injected from a fuel injection valve 14. A throttle valve (not shown) that alters the passage area to modify the air flow is provided in intake manifold 13.

When ignition is effected by an ignition plug 15 on the air-fuel mixture of air and fuel, the air-fuel mixture burns to move a piston 16 back and forth, whereby a crankshaft 17 identified as the engine output shaft rotates. Then, the air-fuel mixture after combustion is output into an exhaust manifold 18 from each combustion chamber 12 as exhaust.

In internal combustion engine 11, the communication between combustion chamber 12 and intake manifold 13 is open/shut by an opening/closing operation of an intake valve 21. The communication between combustion chamber 12 and exhaust manifold 18 is open/shut by an opening/closing operation of an exhaust valve 22. Intake valve 21 and exhaust valve 22 open/close according to the rotation of an intake camshaft 23 and an exhaust camshaft 24 to which the rotation of crankshaft 17 is transmitted.

Crankshaft 17 is linked to a motor generator (hereinafter, referred to as MG) 52 in a driven manner via a clutch mechanism 51. MG 52 is used as a running drive source, likewise internal combustion engine 11, and as a starter motor for the startup of engine 11. In other words, MG 52 functions as "crankshaft drive electric motor" defined in the claims.

In the present embodiment, fuel injection control of a fuel injection valve 14, the ignition time control of ignition plug 15 and the like are effected through an electronic control device 41 that constitutes a portion of the control system the effects the operation control of internal combustion engine 11 and MG 52. Electronic control device 41 includes a central processing unit (CPU) to execute various operations involved in each control, a read-only memory (ROM) in which the program and data for control are recorded, a random access memory in which the operational result of the CPU, data input from a sensor, or the like are stored, and an input and output port to receive and transmit a signal with respect to an external source, and the like.

A signal involved in a startup request of internal combustion engine 11 and/or a signal involved in a stop request are applied to electronic control device 41 via an ignition switch (hereinafter, referred to as IG switch) 42 operated by the driver of the vehicle. A signal corresponding to the stepped amount on an accelerator pedal 44 operated by the driver (accelerator stepped amount) is applied to electronic control device 41 from an accelerator position sensor 43.

Electronic control device 41 executes control involved in switching of the running drive source according to the running state of the vehicle (running drive source switching control). Electronic control device 41 switches between connection and disconnection of clutch mechanism 51 and controls the driving state of MG 52 and internal combustion engine 11 to switch the running drive source therebetween.

At the startup of internal combustion engine 11, for example, power is supplied to MG 52 to drive the same when clutch mechanism 51 is connected (a state in which power transmission between crankshaft 17 and MG 52 is allowed), whereby internal combustion engine 11 is started.

In the case where MG 52 must function as a power generator in an engine operating mode, clutch mechanism 51 is set to a connected state to transmit the output torque of internal combustion engine 11 to MG 52 for driven-rotation. In contrast, in the case where MG 52 does not have to function as a power generator, clutch mechanism 51 is to be cut off (a state where the power transmission between crankshaft 17 and MG 52 is cut).

In the case where only MG 52 is used as the running drive source, power is supplied to MG 52 to drive the same when clutch mechanism 51 is in a disconnected state.

A signal related to the rotational speed of MG 52 (MG speed signal) is applied from MG 52 to electronic control device 41. Electronic control device 41 effects feedback-control of MG 52 based on this MG speed signal.

A valve timing variable mechanism 31 is provided at the valve system of intake valve 21 of internal combustion engine 11. Valve timing variable mechanism 31 is configured to alter continuously the operating angle center (the center of the angle of action of the cam that drives intake valve 21) ϕ of intake valve 21. A mechanism of altering the operating angle center ϕ by modifying the relative rotation phase of crankshaft 17 and intake camshaft 23 is employed as variable mechanism 31.

Figure 2:
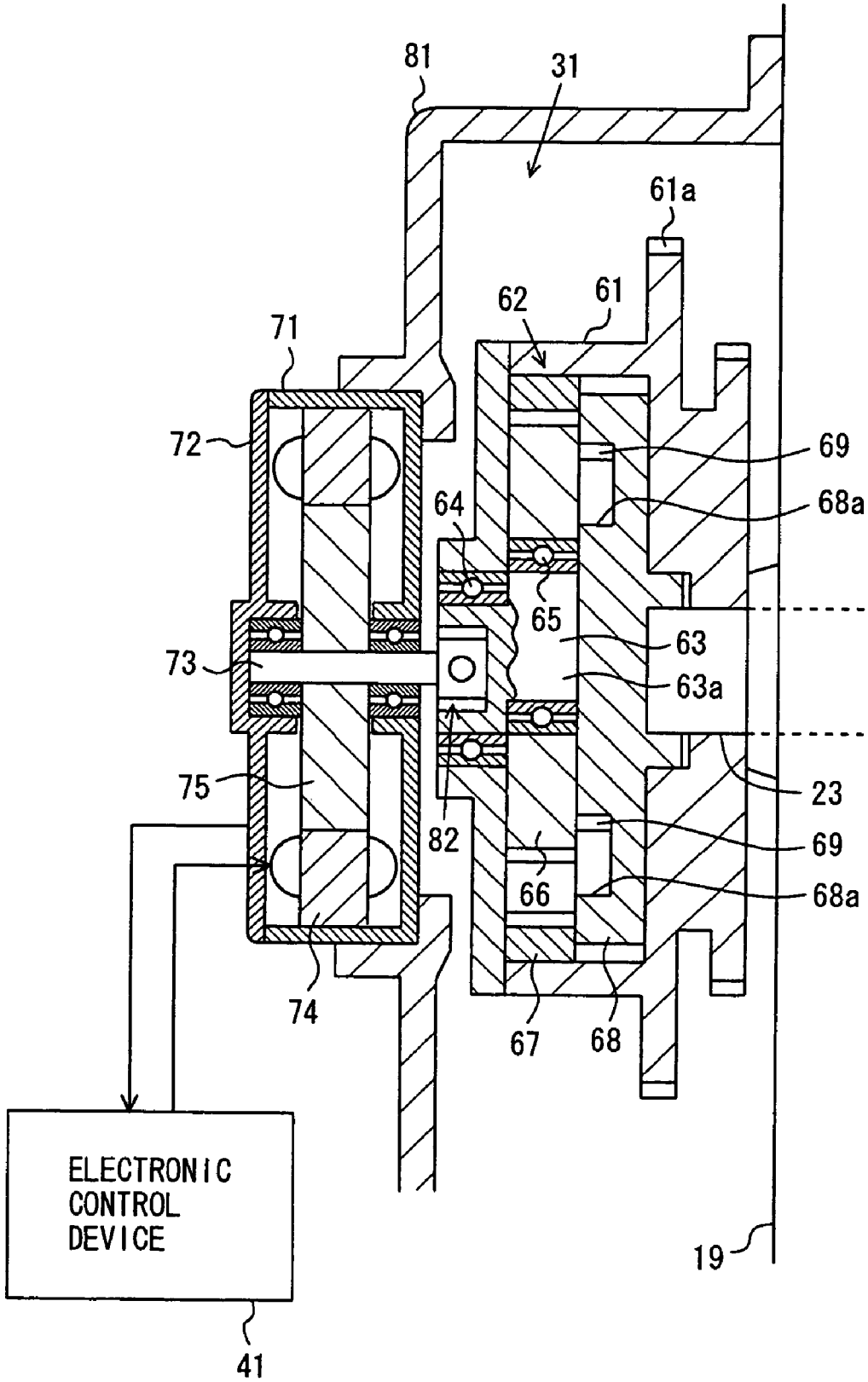
FIG. 2 is a sectional view of a valve timing variable mechanism and VVT motor.

Referring to FIG. 2, valve timing variable mechanism 31 is provided at the outer side of a cylinder head 19 that supports intake camshaft 23.

At an end of intake camshaft 23 projecting outwards from cylinder head 19, a rotor 61 that is substantially hollow and columnar, constituting valve timing variable mechanism 31, is supported in a relatively rotatable manner. At the outer circumference of rotor 61, there is provided in a projecting manner a sprocket 61*a* to which the rotation of crankshaft 17 is transmitted via a chain not shown. In other words, rotor 61 of the present embodiment moving in conjunction with crankshaft 17 functions as "rotary element" in the claims.

Rotor 61 is covered with a chain cover 81 secured to cylinder head 19. A housing 72 of the VVT drive electric motor (hereinafter, referred to as VVT motor) 71 which is the driving source of valve timing variable mechanism 31 is secured to chain cover 81.

In rotor 61 is provided a reduction gear mechanism 62 that reduces the speed of rotation of rotational shaft 73 of VVT motor 71 and transmits the lowered speed to intake camshaft 23.

Reduction gear mechanism 62 of the present embodiment is formed of the so-called reduction gear by use of a cycloid mechanism. Specifically, an eccentric shaft 63 qualified as the input shaft of reduction gear mechanism 62 is supported in a relatively rotatable manner via a bearing 64 at the wall of rotor 61 facing VVT motor 71. Eccentric shaft 63 is linked in a driving manner to a rotational shaft 73 of VVT motor 71 via an Oldham's coupling 82. Eccentric shaft 63 rotates about the same central axis as intake camshaft 23 according to the rotation of rotational shaft 73.

Eccentric shaft 63 includes a columnar eccentric portion 63*a* having a central axis parallel to the central axis of eccentric shaft 63. A pinion gear 66 is supported in a relatively rotatable manner at the outer circumferential side of eccentric portion 63*a* via bearing 65. A ring gear 67 having inner teeth meshing with the outer teeth of pinion gear 66 is secured to the housing of rotor 61. The outer teeth of pinion gear 66 is set slightly lower in number than the inner teeth of ring gear 67.

Pinion gear 66 revolves in an orbit while meshing with ring gear 67 and also rotates on its axis in accordance with the rotation of eccentric shaft 63. At this stage, reduction is effected by the speed of pinion gear 66 rotating on its axis set lower than the rotational speed of eccentric shaft 63, i.e. the rotational speed of rotational shaft 73 of VVT motor 71.

Between pinion gear 66 and intake camshaft 63 in rotor 63 is provided a rotary member 68 that transmits the rotary motion of pinion gear 66 on its axis to intake camshaft 23. Rotary member 68 is affixed to intake camshaft 63 in an integrally rotatable manner. The surface of rotary member 68 facing pinion gear 66 has a plurality of concaves 68*a* formed. Concave 68*a* has an inner circumferential face that is round in cross section. A columnar pin 69 projecting from pinion gear 66 is inserted into each concave 68*a*. The outer circumferential face of each pin 69 forms contact with the inner circumferential face of concave 68*a*.

The revolution of pinion gear 66 in an orbit corresponding to the rotation of eccentric shaft 63 is prevented from being transmitted to rotary member 68 by the revolution of pin 69 along the outer circumferential face of concave 68*a*, and only the rotation of pinion gear 66 on its axis is transmitted to rotary member 68. By this action, the rotation of rotational shaft 73 of VVT motor 71 is reduced and transmitted to intake camshaft 23. Rotary member 68 that transmits the rotation of pinion gear 66 on its axis to intake camshaft 63 at reduction gear mechanism 62 functions as "output shaft" in the claims.

Reduction gear mechanism 62 formed of a reduction gear by use of a cycloid mechanism functions to retain constant the relative rotation phase of intake camshaft 23 and rotational shaft 73 without increasing the speed of eccentric shaft 63, i.e. rotational shaft 73 of VVT motor 71, even if rotary drive force is applied from intake camshaft 23 to rotary member 68.

Reduction gear mechanism 62 also functions to retain constant the relative rotation phase of ring gear 67 and rotary member 68 even if rotary drive force is applied from the part of intake camshaft 23 to rotary member 68. In other words, the relative rotation phase of rotor 61 and intake camshaft 23, i.e. the valve timing of intake valve 21, is retained constant even if the rotary drive force from intake camshaft 23 acts on rotary member 68.

Reduction gear mechanism 62 further functions to retain constant the relative rotation phase of ring gear 67 and eccentric shaft 63 and also the relative rotation phase of ring gear 67 and rotary member 68 even if the rotary drive force is applied to rotor 61, i.e. to ring gear 67, from the part of crankshaft 17. In other words, the relative rotation phase of rotor 61 and intake camshaft 63, i.e. the valve timing of intake valve 21, is retained constant even if the rotary drive force acts on rotor 61 from the part of crankshaft 17.

Therefore, based on the rotation of crankshaft 17, intake camshaft 23 can be rotated in synchronization via rotor 61 that moves in conjunction therewith. Further, when VVT motor 71 is not driven (when power is not fed), rotational shaft 73 can be rotated integrally with intake camshaft 23 (dragged) based on the rotation of crankshaft 17.

Reduction gear mechanism 62 of the present embodiment that retains the valve timing of intake valve 21 at the desired timing functions as "retaining mechanism" in the claims.

Since the mode of feeding power to the coil wound around a stator 74 affixed to housing 72 of VVT motor 71 is under the control of electric control device 41 in the present embodiment, the driving mode of VVT motor 71 such as the rotational speed and rotational amount of motor rotor 75, i.e. rotational shaft 73 affixed to motor rotor 75, will be regulated.

For example, by driving VVT motor 71 to increase the rotational speed of intake camshaft 23 when the engine is to be started, the operating angle center ϕ of intake valve 21 is modified to the advance side, i.e. the valve timing is advanced.

In contrast, by driving VVT motor 71 to reduce the rotational speed of intake camshaft 23, the operating angle center ϕ of intake valve 21 can be modified to the retard side, i.e. the valve timing is retarded.

Figure 3:
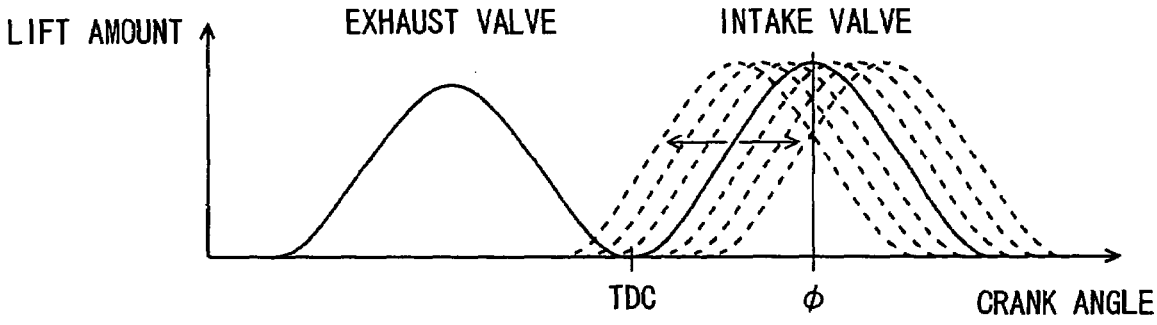
FIG. 3 is a diagram to describe a valve timing modification mode of an intake valve by the valve timing variable mechanism.

By means of the drive control of VVT motor 71 in the present embodiment, the valve timing of intake valve 21 can be advanced or retarded continuously, as shown in FIG. 3.

Valve timing control by electronic control device 41 is effected, for example, as set forth below.

Electronic control device 41 detects the engine rotational speed and the like based on a signal from crank angle sensor 45 (crank angle signal), and also detects the rotational speed and the like of rotational shaft 73 based on a signal (motor rotational speed signal) from a rotational speed sensor not shown, provided at VVT motor 71 (refer to FIG. 1).

Electronic control device 41 calculates the target value of the operating angle center $\phi$ of intake valve 21 suitable for the current engine driving state based on information such as the aforementioned engine rotational speed, the accelerator stepped amount detected through an accelerator position sensor 43, the engine coolant temperature detected through a coolant sensor not shown, and the like. Valve timing variable mechanism 31 is feedback-controlled such that the actual value of the operating angle center $\phi$ of intake valve 21 matches the aforementioned target value based on the motor rotational speed signal, cam angle signal, and crank angle signal. Thus, the optimum valve timing of intake valve 21 corresponding to the current engine operation state can be obtained.

In the present embodiment, the valve timing of intake valve 21 is controlled by electronic control device 41 to attain the desired timing suitable for engine startup in preparation to engine startup based on the operation of IG switch 42 or the above-described running drive source switching control (electronic control device 41 constitutes "control means" in the claims). The desired valve timing (target value) is calculated based on information set forth above such as the engine coolant temperature. Since the fuel combustion state in combustion chamber 12 is liable to become unstable when the engine coolant temperature is low, the target valve timing in preparation to the aforementioned engine startup is set to a value corresponding to the retard side to improve combustion stabilization.

Figure 4:
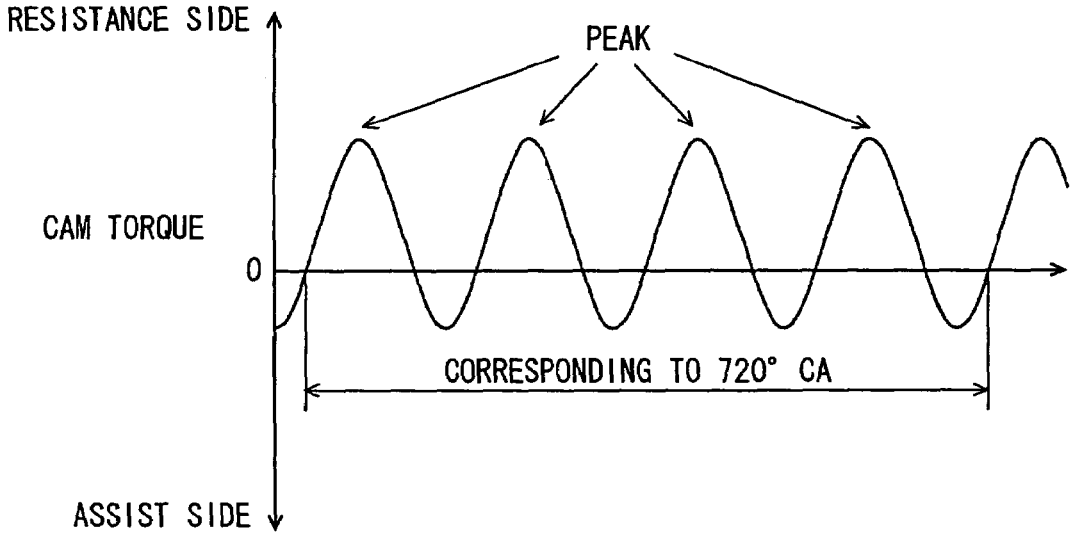
FIG. 4 is a diagram representing a cam torque variable mode when an intake camshaft is rotated.

When intake camshaft 23 is to be rotated by crankshaft 17 or VVT motor 71, the cam torque that increases and reduces periodically in accordance with the rotation of shaft 23 acts on the part of reduction gear mechanism 62, as shown in FIG. 4. For example, in the case where the valve timing is to be modified such that the cam torque acts as a resistance (resistance cam torque), the relative rotation phase of intake camshaft 23 and crankshaft 17 must be modified by driving intake camshaft 23 in rotation against this torque.

In FIG. 4, the upper side of cam torque "0" corresponds to the aforementioned resistance cam torque, whereas the lower side of "0" corresponds to the assist cam torque (cam torque acting to assist the rotation of intake camshaft 23). The resistance cam torque acts to impede the rotation of intake camshaft 23 no matter whether intake camshaft 23 is rotated in the positive direction (rotation in the direction identical to that of engine operation) or in the opposite direction. In contrast, the assist cam torque acts to assist the rotation of intake camshaft 23 no matter whether intake cam haft 23 is rotated in the positive direction or in the opposite direction.

In the case where valve timing variable mechanism 31 is to be driven in preparation to engine startup, i.e. driving variable mechanism 31 by VVT motor 71 in an engine stopped state such as when the valve timing is to be modified to the timing suitable for engine startup as set forth above, motor torque of a level that can drive variable mechanism 31 against the resistance cam torque is required.

Assume that a valve timing modification request is made in engine startup to rotate intake camshaft 23 until the resistance cam torque reaches the peak. In this case, by employing an electronic motor that can output motor torque of a level equivalent to driving valve timing variable mechanism 31 against the peak resistance cam torque at the peak for VVT motor 71, the valve timing can be modified according to the request. By employing such an electric motor for VVT motor 71, the valve timing can be modified whatever level the resistance cam torque may take within the variable range.

However, the requirement of a high output from VVT motor 71 will impede downsizing of VVT motor 71, which in turn will impede downsizing of internal combustion engine 11. The pursuit of such a high output that allows valve timing variable mechanism 31 to be driven against the resistance cam torque attaining the peak level raises concerns about the aforementioned problem becoming more noticeable.

In the present embodiment, the valve timing control set forth below is executed in preparation to engine startup in order to reduce the output torque of VVT motor 71.

Figure 5:
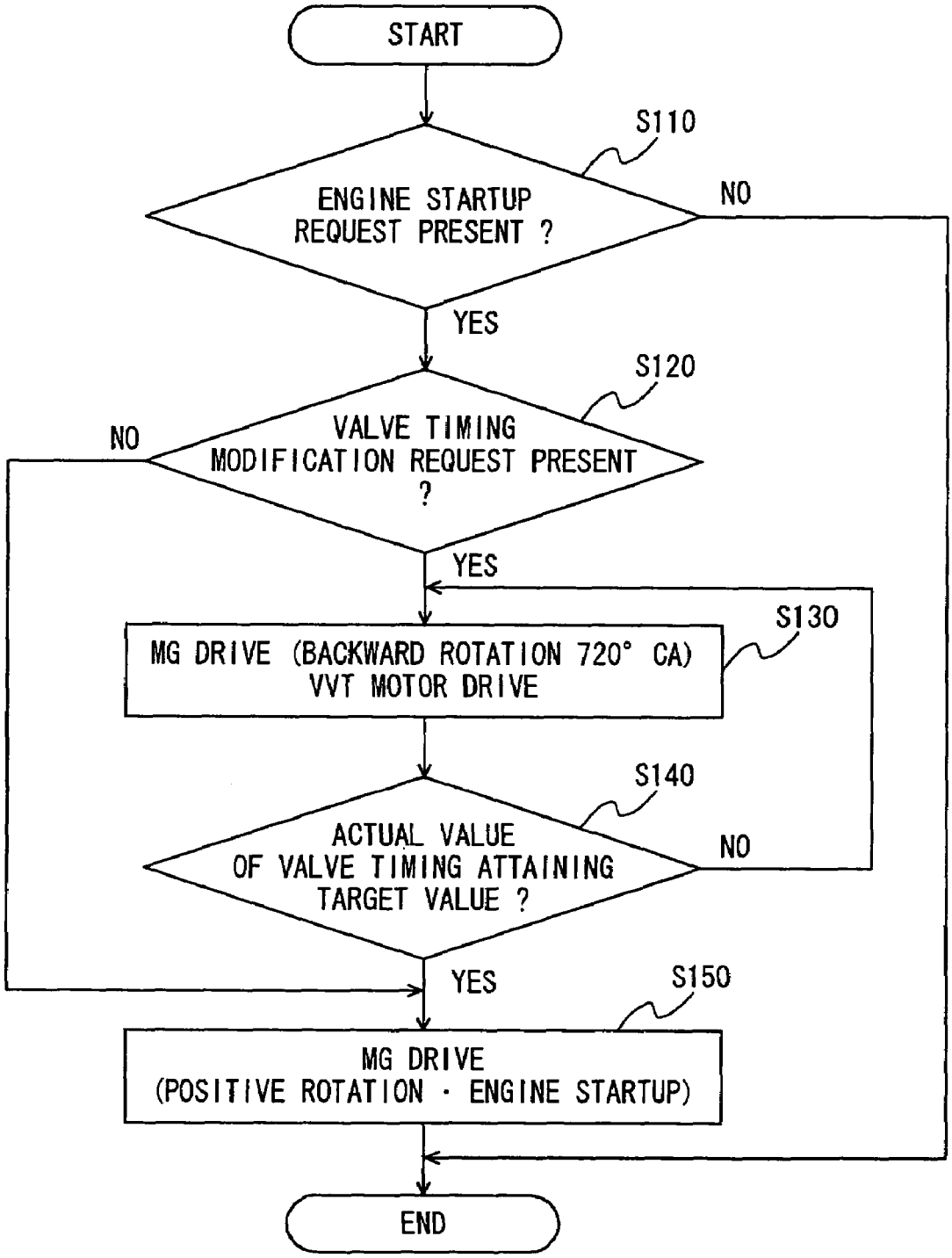
FIG. 5 is a flow chart of engine startup valve timing control.

The control procedure executed by electronic control device 41 will be described hereinafter with reference to the flow chart of FIG. 5. A control routine in this flow chart is executed at every predetermined time in an interrupting manner.

In the control routine, the presence of an engine startup request by the driver based on a signal through IG switch 42 or an engine startup request according to switching of the vehicle running drive source is identified when internal combustion engine 11 is in a stopped state (step S110). When determination is made that there is no engine startup request, the process ends (step S110: NO).

When the determination result at step S10 is YES, i.e. when determination is made that there is an engine startup request set forth above, control proceeds to step S120.

At step S120, determination is made whether there is a valve timing modification request for intake valve 21. This modification request is made when the valve timing target value calculated based on information such as the engine coolant temperature and the like set forth above differs from the current actual value. In other words, this modification request is issued based on determination made by electronic control device 41 itself.

When the determination result is NO, i.e. when determination is made that there is no valve timing modification request, MG 52 is driven in the direction of positive rotation (cranking) with clutch mechanism 51 in a connected state to start internal combustion engine 10 without modifying the valve timing (step S1150).

When the determination result of step S120 is YES, i.e. when determination is made that there is a valve timing modification request, control proceeds to step S130.

At step S130, MG 52 and VVT motor 71 are both driven at the same time. At this stage, MG 52 is driven in order to rotate crankshaft 17 in the opposite direction for 720° CA (CA implies "crank angle"), i.e. cause rotor 61 to make one cycle of rotation in the opposite direction, through feedback-control based on the crank angle signal from crank angle sensor 45 and/or the aforementioned MG rotational speed signal.

During this drive of MG 52, VVT motor 71 is driven such that the actual value of the valve timing of intake valve 21 attains the target value. For example, when the valve timing is to be modified in the advancing side, VVT motor 71 is driven such that intake camshaft 23 rotates in the positive direction relatively with respect to rotor 61. In contrast, when the valve timing is to be modified in the retarding side, VVT motor 71 is driven such that intake camshaft 23 rotates in the opposite direction relatively with respect to rotor 61.

The rotatable drive of rotor 61 by MG 52 during the drive of VVT motor 71 causes intake camshaft 23 to be driven in rotation by MG 52 even when the torque required to drive intake camshaft 23 in rotation is at the maximum level, i.e. even when the resistance cam torque reaches its peak. In other words, the torque required to drive intake camshaft 23 to exceed the peak level of the resistance cam torque is obtained from MG 52. Accordingly, the maximum output torque of VVT motor 71 can be set smaller as compared to the case where intake camshaft 23 is driven by VVT motor 71 alone to exceed the peak of the resistance cam torque. Thus, downsizing of VVT motor 71 is allowed.

Since crankshaft 71 is driven in rotation for just 720° CA by MG 52, there is inevitably a period in which the assist cam torque is generated during the driving period (refer to FIG. 4). Therefore, valve timing variable mechanism 31 can be driven by VVT motor 71 during the period in which the assist cam torque acts. Thus, the required output torque from VVT motor 71 is reduced corresponding to the drive.

Since crankshaft 17 is rotated in the opposite direction by MG 52 as set forth above, unburned gas remaining in combustion chamber 12 will be returned towards intake manifold 13. This prevents the unburned gas from being exhausted outside via exhaust manifold 18.

At step 140, determination is made whether the valve timing modification of step S130 is completed or not, i.e. whether the actual value of the valve timing attains the target value. When the determination result is NO, i.e. when determination is made that the actual value of the valve timing does not yet meet the target value, control returns to step S130 for re-execution. When the determination result of step S140 is YES, i.e. when determination is made that the actual value of the valve timing meets the target value, control returns to step S130, and cranking by MG 52 is effected.

The process of steps S120 and S130 corresponds to "engine startup valve timing control" in the claims.

Figure 6:
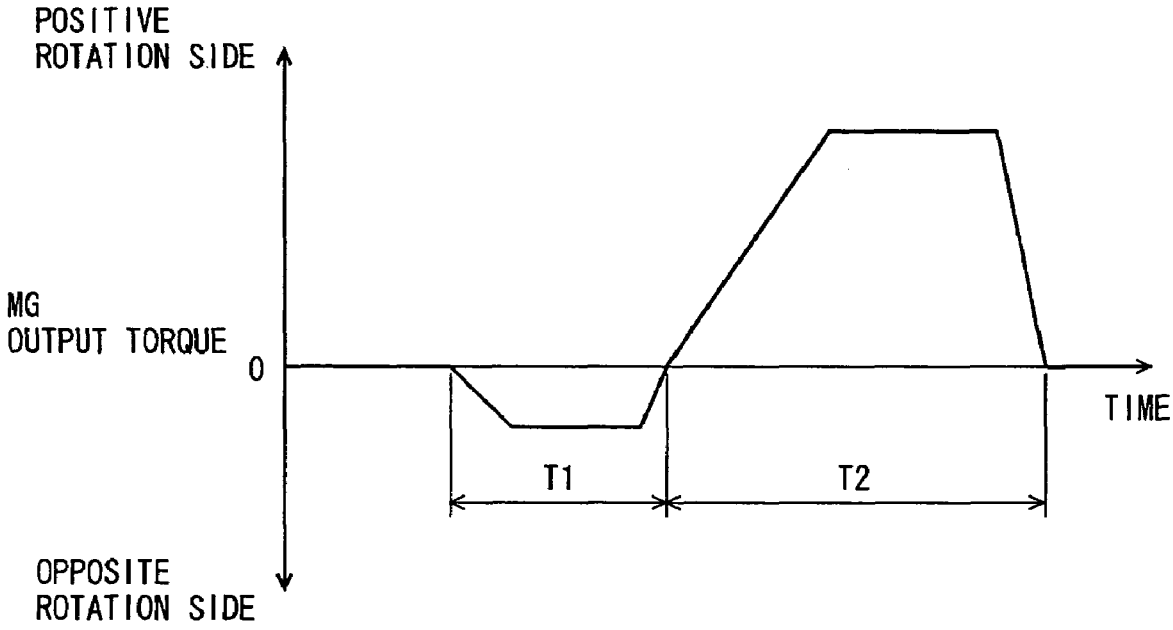
FIG. 6 represents the transition of MG output torque.

FIG. 6 shows an example of the output torque transition of MG 52 when the series of steps set forth above is executed. Referring to FIG. 6, an engine startup request and a valve timing modification request causes MG 52 to be driven such that crankshaft 17 is rotated for 720° CA in the opposite direction (term T1). During term T1, the valve timing of intake camshaft 23 is modified through the drive of VVT motor 71. When the valve timing attains the desired timing, MG 52 is driven in the positive rotation direction, and cranking is effected (term T2)

Intake camshaft 23 is driven in rotation through MG 52 during term T1, such that the output torque of VVT motor 71 required for valve timing modification is reduced.

The present embodiment offers the advantages set forth below.

(1) Electronic control device 41 drives VVT motor 71 while driving MG 52 in the engine startup valve timing control. Accordingly, VVT motor 71 is driven with crankshaft 17 rotated towards reducing the resistance cam torque by MG 52, or VVT motor 71 is driven with crankshaft 17 rotated such that the resistance cam torque reaches the peak by MG 52.

For example, during the term in which VVT motor 71 is driven with crankshaft 17 rotated towards reducing the resistance cam torque by MG 52, the advantage set forth below is obtained. Even if a valve timing modification request is made to drive VVT motor 71 towards increasing the resistance cam torque at this stage, the output torque of VVT motor 71 can be reduced since MG 52 rotates crankshaft 17 towards reducing the resistance cam torque. Therefore, downsizing VVT motor 71 is allowed.

During the term in which VVT motor 71 is driven with crankshaft 17 rotated such that the resistance cam torque reaches the peak by MG 52, the advantage set forth below is obtained. Even if a valve timing modification request is made to drive VVT motor 71 such that the resistance cam torque reaches or exceeds the peak at this stage, the resistance cam torque reaches the peak by the rotation-drive of crankshaft 17 through MG 52.

Therefore, the output torque of VVT motor 71 can be reduced as compared to the case where intake camshaft 23 is rotated by VVT motor 71 alone until the resistance cam torque reaches the peak. Thus, downsizing of VVT motor 71 is allowed.

The drive of VVT motor 71 while driving MG 52 as set forth above in the present embodiment allows intake camshaft 23 to be rotated by MG 52 (via crankshaft 17 and rotor 61) until the cam torque acts to assist modification of the valve timing.

The cam torque has the variation property of exhibiting alternately in a cyclic manner a resistance to rotation (resistance cam torque) and assisting rotation in association with the rotation of intake camshaft 23. Since MG 52 is driven until the rotation of intake camshaft 23 is assisted by the cam torque in the present embodiment, the output torque of VVT motor 71 in a valve timing modification mode can be reduced significantly.

The control mode of MG 52 and VVT motor 71 includes, in addition to the control set forth above, driving MG 52 until the resistance cam torque is reduced to a torque value that allows intake camshaft 23 to be rotated by VVT motor 71 alone, and then driving VVT motor 71 to modify the valve timing.

In this case, the drive amount of MG 52 must be controlled accurately since MG 52 must be stopped in the state where the resistance cam torque is reduced to a certain predetermined torque value.

By employing the above-described control mode of driving VVT motor 71 while driving MG 52, the drive amount of MG 52 can be set to an arbitrary amount as long as it is sufficient for valve timing modification. For example, the drive amount of MG 52 can be fixed to a predetermined amount (in the present embodiment, corresponding to 720° CA). Therefore, the control manner of electric control device 41 can be made simple.

Further, since the relative rotation phase of shafts 17 and 23 can be modified by VVT motor 71, i.e. the valve timing can be modified, during the rotatable drive of intake camshaft 23 by MG 52, the time from a valve timing modification request being made until completion of modification can be shortened.

(2) Electronic control device 41 drives MG 52 in order to rotate crankshaft 17 in the opposite direction in the engine startup valve timing control. Since the rotation of crankshaft 17 is opposite in direction to that of engine operation, the unburned gas remaining in combustion chamber 12 can be returned towards intake manifold 13. Therefore, the unburned gas can be prevented from being exhausted outside via exhaust manifold 18.

Since a direct-injection type fuel injection valve 14 that injects fuel directly into combustion chamber 12 is employed in the present embodiment, the interior of injection valve 14 particularly attains high pressure, as compared to the case where a fuel injection valve of the type that injects fuel to intake manifold 13, for example, is employed.

This corresponds to the state where fuel leakage from injection valve 14 to combustion chamber 16 may readily occur. Therefore, the control mode of rotating crankshaft 17 in the opposite direction in internal combustion engine 11 that includes such a direct-injection type fuel injection valve 14 is particularly useful in improving the exhaust performance.

(3) In the above-described embodiment, a reduction gear mechanism 62 formed of reduction gear by use of a cycloid mechanism is employed.

The reduction gear by use of a cycloid mechanism serves to cause the output shaft to generate rotational speed lower than that of the input shaft by transmitting the rotary motion of one or the other of the ring gear and pinion gear constituting the reduction gear by use of a cycloid mechanism on its axis that occurs by the revolution of one or the other of the ring gear and pinion gear in an orbit based on the rotation of the input shaft. For example, by the revolution of pinion gear 66 in an orbit based on the rotation of eccentric shaft 63 in the present embodiment, the rotating motion of pinion gear 66 on its axis can be transmitted to rotate rotary member 68.

By virtue of reduction gear mechanism 62 set forth above, the relative rotation phase of intake camshaft 23 and rotational shaft 73 of VVT motor 71 and also the relative rotation phase of intake camshaft 23 and crankshaft 17 are retained constant even if cam torque is transmitted from intake camshaft 23 to rotary member 68. This relative rotation phase retaining function is effective regardless of what value the relative rotation phase takes. In other words, this function allows the valve timing to be retained at the desired timing.

Reduction gear mechanism 62 also serves to retain the relative rotation phase of rotor 61 and eccentric shaft 63 constant and the relative rotation phase of rotor 61 and rotary member 68 constant even if rotary drive force is applied to ring gear 67, i.e. rotor 61.

Therefore, based on the rotation of crankshaft 17, intake camshaft 23 can be rotated in synchronization via rotor 61 that moves in conjunction therewith. Further, when VVT motor 71 is not driven, rotational shaft 73 can be made to rotate integrally (dragged) with rotor 61 and in turn intake camshaft 23, based on the rotation of crankshaft 17. Accordingly, the energy can be saved and the durability of the battery (secondary battery) qualified as the power source can be improved since power does not have to be fed to VVT motor 71 when it is not required to modify the valve timing.

In the present embodiment, the output torque of VVT motor 71 can be reduced correspondingly by the reduction capability of reduction gear mechanism 62. This allows VVT motor 71 to be reduced in size.

By employing a reduction gear by use of a cycloid mechanism functioning as a retaining mechanism, modification of the valve timing, when requested, is allowed while intake camshaft 23 is moved in conjunction with crankshaft 17, in addition to the valve timing retaining function. This in turn provides various advantages such as allowing downsizing of VVT motor 71.

(4) In the process of step S130 in the flow chart set forth above of the present embodiment, the rotation driving angle of crankshaft 17 by MG 52 is set to 720° CA. In other words, crankshaft 17 is rotated in units of 720° CA in the engine startup valve timing control. Since the crank angle at the time point of ending the valve timing control is identical to the crank angle at the time point of initiation of the valve timing control, the event of the first ignited cylinder among the plurality of cylinders being altered according to execution of the valve timing control at the time of cranking following completion of the valve timing control will no longer occur. This means that control of the target cylinder to be ignited to accommodate such cylinder change is dispensable.

The embodiment of the present invention is not limited to that described above, and may be conducted in the following manner.

Although crankshaft 17 is rotated in units of 720° CA by MG 52 in the engine startup valve timing control in the embodiment set forth above, this limitation of the rotation angle is not mandatory. For example, crankshaft 17 may be rotated in units of another rotation angle. The drive of MG 52 may be forced to stop irrespective of the rotation angle of crankshaft 17 when valve timing modification is completed.

The time to initiate driving of MG 52 and VVT motor 71 in the engine startup valve timing control may be identical or different. In the case where the time to initiate driving differs, any of MG 52 and VVT motor 71 may first be initiated in driving.

In the above-described embodiment, VVT motor 71 is driven while MG 52 is driven in the engine startup valve timing control. In other words, there is a period during which both MG 52 and VVT motor 71 are driven. Alternatively, the driving period of MG 52 may be deviated from the driving period of VVT motor 71 such that there is no overlapping period. For example, a control mode may be employed in which MG 52 is driven until the resistance cam torque is reduced to a torque value that allows intake camshaft 23 to be rotated by VVT motor 71 alone, and then driving VVT motor 71 after MG 52 is stopped to modify the valve timing.

Further, when crankshaft 17 is rotated by MG 52 such that the resistance cam torque reaches the peak, crankshaft 17 does not necessarily have to be rotated such that the resistance cam torque exceeds the peak. Rotation of crankshaft 17 may be stopped before resistance cam torque reaches the peak. Such a control mode also allows the output torque of VVT motor 71 to be reduced since it is no longer required to rotate intake camshaft 23 until the resistance cam torque reaches the peak by VVT motor 71 alone. Accordingly, downsizing of VVT motor 71 is allowed.

In the above-described embodiment, intake camshaft 23 is rotated by the driving force of MG 52 until the cam torque functions to assist modification of the valve timing in the engine startup valve timing control. This control mode is not mandatory. For example, MG 52 can be driven in order to reduce the resistance cam torque to the level of a torque value that allows intake camshaft 23 to be rotated by VVT motor 71 alone. In this case, downsizing of VVT motor 71 is facilitated as the resistance cam torque becomes smaller by the drive of MG 52.

In the above-described embodiment, VVT motor 71 is driven to rotate crankshaft 17 in the opposite direction in the engine startup valve timing control. The present invention is not limited thereto, and crankshaft 17 may be rotated in the positive direction.

In the above-described embodiments, the engine startup valve timing control is effected in response to an engine startup request. The present invention is not limited thereto, and the engine startup valve timing control may be effected in response to an engine stop request. For example, the process corresponding to step S130, i.e. valve timing modification, is to be effected when an engine stop request is made based on the running drive source switching control or an OFF operation via IG switch 42 and also a valve timing modification request is made. Accordingly, valve timing control will be completed in preparation to engine startup at the point in time when an engine startup request is made.

Therefore, the time from an engine startup request up to completion of engine startup can be shortened as compared to the mode in which engine startup valve timing control is executed in response to an engine startup request.

In the above-described embodiment, a reduction gear by use of a cycloid mechanism of the type that causes pinion gear 66 to revolve in an orbit is employed as reduction gear mechanism 62. The present invention is not limited thereto. A reduction gear by use of a cycloid mechanism that has a pinion gear affixed to the housing of rotor 61, qualified as a sun gear, and a ring gear caused to revolve in an orbit by VVT motor 71 via the eccentric shaft, qualified as a planetary gear, may be employed.

Although a reduction gear by use of a cycloid mechanism functioning as a retaining mechanism is employed in the embodiment, the present invention is not limited thereto, and another reduction gear mechanism may be employed. If this another reduction gear mechanism per se can function as a retaining mechanism, likewise the reduction gear by use of a cycloid mechanism set forth above, no particular retaining mechanism has to be provided (however, provision is not prohibited). If this another reduction gear mechanism is absent of a retaining mechanism, an appropriate retaining mechanism must be provided in addition to the reduction gear mechanism. For example, an electromagnetic clutch mechanism that mechanically connects/disconnects the part of rotor 61 and the part of intake camshaft 23 in response to an instruction from electronic control device 41 may be employed for such a retaining mechanism.

In the above-described embodiment, stator 74 of VVT motor 71 is affixed to cylinder head 19 via chain cover 81 and the like. The present invention is not limited thereto, and stator 74 may be affixed to rotor 61 by incorporating VVT motor 71 per se in rotor 61.

In the above-described embodiment, MG 52 is employed as the electric motor to drive the crankshaft. The present invention is not limited thereto, and any electric motor that can output torque sufficient to rotate crankshaft 17 may be employed such as an electric motor that functions only as a starter motor.

The present invention is applied to a device that controls the valve timing of intake valve 21 in the above-described embodiment. The present invention is also applicable to a device that modifies the valve timing of exhaust valve 22.

In the above-described embodiment, an in-line 4-cylinder or V8-cylinder type engine was employed for the internal combustion engine. The present invention is not limited thereto, and an engine with more than or less than 4 cylinders per camshaft, such as an in-line 3-cylinder, V6-cylinder, in-line 5-cylinder, VI O-cylinder type engine or the like, may be employed.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

What is claimed is:

1. A valve timing control device for an internal combustion engine, comprising a variable mechanism rendering valve timing variable through modification of a relative rotation phase of a crankshaft and a camshaft linked to the crankshaft in a driving manner, a VVT drive electric motor driving said variable mechanism, a retaining mechanism that can retain said valve timing at the desired timing, and a control unit controlling said valve timing to attain the desired timing through said variable mechanism in preparation to engine startup, wherein said control unit executes engine startup valve timing control to drive said VVT drive electric motor with said crankshaft rotated towards reducing cam torque qualified as a resistance through a crankshaft drive electric motor differing from said VVT drive electric motor when a valve timing modification request is made in preparation to engine startup.

2. The valve timing control device for an internal combustion engine according to claim 1, wherein a reduction gear by use of a cycloid mechanism is employed as said retaining mechanism, an input shaft causing one of a ring gear and a pinion gear meshing with the ring gear, constituting said reduction gear, to revolve in an orbit is linked to a rotational shaft of said VVT drive electric motor in a driving manner, the other of said ring gear and pinion gear is secured to a rotary element that moves in conjunction with said crankshaft, and an output shaft transmitting rotation of one or the other of said gears on its axis caused by revolution of said one of the gears is linked to said camshaft in a driving manner.

3. The valve timing control device for an internal combustion engine according to claim 1, wherein said control unit drive said crankshaft drive electric motor in order to rotate said camshaft until cam torque functions to assist modification of said valve timing in said engine startup valve timing control.

4. The valve timing control device for an internal combustion engine according to claim 1, wherein said control unit drives said VVT drive electric motor while driving said crankshaft drive electric motor in said engine startup valve timing control.

5. The valve timing control device for an internal combustion engine according to claim 1, wherein said control unit drives said crankshaft drive electric motor in order to rotate said crankshaft in an opposite direction in said engine startup valve timing control.

6. The valve timing control device for an internal combustion engine according to claim 1, wherein said control unit executes said engine startup valve timing control in response to an engine stop request.

7. A valve timing control device for an internal combustion engine, comprising a variable mechanism rendering valve timing variable through modification of a relative rotation phase of a crankshaft and a camshaft linked to the crankshaft in a driving manner, a VVT drive electric motor driving said variable mechanism, a retaining mechanism that can retain said valve timing at the desired timing, and a control unit controlling said valve timing to attain the desired timing through said variable mechanism in preparation to engine startup, wherein said control unit executes engine startup valve timing control to drive said VVT drive electric motor with said crankshaft rotated such that cam torque qualified as a resistance reaches a peak through a crankshaft drive electric motor differing from said VVT drive electric motor when a valve timing modification request is made in preparation to engine startup.

8. A valve timing control device for an internal combustion engine, comprising a variable mechanism rendering valve timing variable through modification of a relative rotation phase of a crankshaft and a camshaft linked to the crankshaft in a driving manner, a VVT drive electric motor driving said variable mechanism, a retaining mechanism that can retain said valve timing at the desired timing, and control means for controlling said valve timing to attain the desired timing through said variable mechanism in preparation to engine startup, wherein said control means includes means for executing engine startup valve timing control to drive said VVT drive electric motor with said crankshaft rotated towards reducing cam torque qualified as a resistance through a crankshaft drive electric motor differing from said VVT drive electric motor when a valve timing modification request is made in preparation to engine startup.

9. The valve timing control device for an internal combustion engine according to claim 8, wherein a reduction gear by use of a cycloid mechanism is employed as said retaining mechanism, an input shaft causing one of a ring gear and a pinion gear meshing with the ring gear, constituting said reduction gear, to revolve in an orbit is linked to a rotational shaft of said VVT drive electric motor in a driving manner, the other of said ring gear and pinion gear is secured to a rotary element that moves in conjunction with said crankshaft, and an output shaft transmitting rotation of one or the other of said gears on its axis caused by revolution of said one of the gears is linked to said camshaft in a driving manner.

10. The valve timing control device for an internal combustion engine according to claim 8, wherein said control means includes means for driving said crankshaft drive electric motor in order to rotate said camshaft until cam torque functions to assist modification of said valve timing in said engine startup valve timing control.

11. The valve timing control device for an internal combustion engine according to claim 8, wherein said control means includes means for driving said VVT drive electric motor while driving said crankshaft drive electric motor in said engine startup valve timing control.

12. The valve timing control device for an internal combustion engine according to claim 8, wherein said control means includes means for driving said crankshaft drive electric motor in order to rotate said crankshaft in an opposite direction in said engine startup valve timing control.

13. The valve timing control device for an internal combustion engine according to claim 8, wherein said control means includes means for executing said engine startup valve timing control in response to an engine stop request.

14. A valve timing control device for an internal combustion engine, comprising a variable mechanism rendering valve timing variable through modification of a relative rotation phase of a crankshaft and a camshaft linked to the crankshaft in a driving manner, a VYT drive electric motor driving said variable mechanism, a retaining mechanism that can retain said valve timing at the desired timing, and control means for controlling said valve timing to attain the desired timing through said variable mechanism in preparation to engine startup, wherein said control means includes means for executing engine startup valve timing control to drive said VVT drive electric motor with said crankshaft rotated such that cam torque qualified as a resistance reaches a peak through a crankshaft drive electric motor differing from said VVT drive electric motor when a valve timing modification request is made in preparation to engine startup.

15. A valve timing control method for an internal combustion engine including a variable mechanism rendering valve timing variable through modification of a relative rotation phase of a crankshaft and a camshaft linked to the crankshaft in a driving manner, a VVT drive electric motor driving said variable mechanism, and a retaining mechanism that can retain said valve timing at a desired timing, comprising the steps of:

determining engine startup, detecting a valve timing modification request in preparation to said engine startup, and controlling such that said VVT drive electric motor is driven with said crankshaft rotated towards reducing cam torque qualified as a resistance through a crankshaft drive electric motor differing from said VVT drive electric motor.

16. The valve timing control method for an internal combustion engine according to claim 15, wherein a reduction gear by use of a cycloid mechanism is employed as said retaining mechanism, an input shaft causing one of a ring gear and a pinion gear meshing with the ring gear, constituting said reduction gear, to revolve in an orbit is linked to a rotational shaft of said VVT drive electric motor in a driving manner, the other of said ring gear and pinion gear is secured to a rotary element that moves in conjunction with said crankshaft, and an output shaft transmitting rotation of one or the other of said gears on its axis caused by revolution of said one of the gears is linked to said camshaft in a driving manner.

17. The valve timing control method for an internal combustion engine according to claim 15, wherein said step of controlling such that said VVT drive electric motor is driven includes the step of driving said crankshaft drive electric motor in order to rotate said camshaft until cam torque functions to assist modification of said valve timing in said engine startup valve timing control.

18. The valve timing control method for an internal combustion engine according to claim 15, wherein said step of controlling such that said VVT drive electric motor is driven includes the step of driving said VVT drive electric motor while driving said crankshaft drive electric motor in said engine startup valve timing control.

19. The valve timing control method for an internal combustion engine according to claim 15, wherein said step of controlling such that said VVT drive electric motor is driven includes the step of driving said crankshaft drive electric motor in order to rotate said crankshaft in an opposite direction in said engine startup valve timing control.

20. The valve timing control method for an internal combustion engine according to claim 15, wherein said step of controlling such that said VVT drive electric motor is driven includes the step of executing said engine startup valve timing control in response to an engine stop request.

21. A valve timing control method for an internal combustion engine including a variable mechanism rendering valve timing variable through modification of a relative rotation phase of a crankshaft and a camshaft linked to the crankshaft in a driving manner, a VVT drive electric motor driving said variable mechanism, and a retaining mechanism that can retain said valve timing at a desired timing, comprising the steps of:

determining engine startup, detecting a valve timing modification request in preparation to said engine startup, and controlling such that said VVT drive electric motor is driven with said crankshaft rotated such that cam torque qualified as a resistance reaches a peak through a crankshaft drive electric motor differing from said VVT drive electric motor.

* * * * *

UNITED STATES PATENT AND TRADEMARK OFFICE

CERTIFICATE OF CORRECTION

PATENT NO. : 7,316,213 B2
APPLICATION NO. : 11/528346
DATED : January 8, 2008
INVENTOR(S) : Ryuta Teraya It is certified that error appears in the above-identified patent and that said Letters Patent is hereby corrected as shown below:

Title Page;

Please delete the following:

"(73) Assignee: Toyota Jidosha Kabushiki Japan"

and replace with the following:

--(73) Assignee: Toyota Jidosha Kabushiki Kaisha--

Signed and Sealed this

Fourth Day of August, 2009

JOHN DOLL
*Acting Director of the United States Patent and Trademark Office*